United States Patent [19]

Safar et al.

[11] Patent Number: 4,866,926

[45] Date of Patent: Sep. 19, 1989

[54] FIBRE LOOSENING DEVICE FOR A SPINNING UNIT OF SPINNING MACHINE

[75] Inventors: Václav Safar; Petr Ursíny, both of Liberec, Czechoslovakia

[73] Assignee: Elitex, Liberec, Czechoslovakia

[21] Appl. No.: 207,086

[22] Filed: Jun. 15, 1988

[30] Foreign Application Priority Data

Jun. 15, 1987 [CS] Czechoslovakia ..... 4378-87

[51] Int. Cl.[4] ..... D01H 7/892; D01H 7/895; D01G 15/40

[52] U.S. Cl. ..... 57/408; 19/83; 19/105; 57/412

[58] Field of Search ..... 57/408–412; 19/82, 83, 98, 105

[56] References Cited

U.S. PATENT DOCUMENTS 3,571,859 3/1971 Doudlebsky et al. ..... 19/105
4,251,984 2/1981 Ripka et al. ..... 57/412
4,254,612 3/1981 Miyamoto et al. ..... 57/408
4,459,801 7/1984 Stahlecker et al. ..... 57/412

*Primary Examiner*—John Petrakes
*Attorney, Agent, or Firm*—Klein & Vibber

[57] ABSTRACT

Fibre loosening device for a spinning unit of a spinning machine. The invention relates to a fibre loosening device for a spinning unit of a spinning machine. Before entering the fibre separating area, the sliver is longitudinally separated into fibre sections fed to a separating region, i.e., to helix-like arranged functional lines on the fibre separating roller, such feeding being non-simultaneous but sequential. The division into the fibre sections is initially carried out by means of protrusions defining grooves therebetween on a condenser, the axial distance between these grooves not being an integer multiple of the helix lead width of the functional lines on the fiber separating roller. The arrangement provides for reducing periodical irregularities of the fibres for the subsequent spinning process.

3 Claims, 1 Drawing Sheet

FIBRE LOOSENING DEVICE FOR A SPINNING UNIT OF SPINNING MACHINE

FIELD OF THE INVENTION

The invention relates to a fibre loosening device for a spinning unit of a spinning machine intended to increase the uniformity of loosened fibres streaming into a spinning rotor or into another spinning system, and to reduce the periodical irregularities in loosened fibre supply having a frequency corresponding to that of the fibre separating roller.

BACKGROUND OF THE INVENTION

In open-end spinning machines, the sliver is fed into the spinning unit by a feed unit in which it is loosened by means of the functional lines of the fibre separating roller and thereby is transformed into a steam of loosened fibres which is fed by suction into the spinning rotor on whose collecting surface the fibres are collected into a fibre band and are then subjected to twisting by rotation and thus transformed into yarn, continually drawn away from the collecting surface, and wound on bobbin.

For the end-use properties of the yarn and for the spinning process stability it is very important to ensure that the fiber loosening out of the sliver is effected as perfectly as possible. The ideal state here is a uniform stream of seperated fibres. The more closely the spinning unit and its operational features come to this ideal state in the fibre separation, the better results can be achieved, especially in the production of high-grade fine yarns.

A detailed study of the fibre separation process, carried out with available technical means and accompanied by the respective measurements, has shown that the operational points of the fibre separating roller separate up to single fibres, only a part of to total fiber material, while the rest are only divided into groups consisting each of a varying number of fibres. The proportion between these two parts of fibers depends on the state in which the fibres are in the sliver and on other process parameters, especially on the number of fibres processed by the fibre separating roller in a time unit.

To deviations from the uniformity of the stream of separated fibres are, on the one hand, irregular and occuring at random in time, and, on the other hand, as established by repeated measurements, regular with a constant frequency corresponding to the frequency speed of the fibre separating roller; the latter effect is due to a sort of periodicity of the fibre separating roller which results from the fact that the functional lines are arranged on its surface along a helix line. In its most unusual version, which is the easiest to produce at the same time, the fibre separating roller is fitted with a saw-like coating wound in a helix groove, and varying in angles and dimensions so as to suit the particular fiber type to be processed.

Fibre separating rollers with saw-like coating arranged in a double-threaded helix line are also known, as well as those featuring needles inserted into their surface and acting as functional points. The various design versions of fiber separating needle rollers are aimed above all at a reduction of their production costs which are considerably higher than those of the saw-like coating type.

The known types of the fibre separating roller have their typical function properties as well as their drawbacks. The saw-like coating type ones are cheaper to produce and with various saw-like coatings can be sufficiently versatile.

A drawback of the saw-like coating type resides in that the helix arrangement pushes the fibres under separation, thus giving rise to irregularities in the stream of separated fibres. The multiple-threaded helix arrangement reduces the amplitude and increases the frequency of such deviations, at the same time still more intensely pushing the fibre fringe. The production costs of this version of the fibre separating roller are somewhat higher.

As a rule, the fibre separating needle rollers have a lower total number of functional points which affect the degree (i.e., the intensity) of the fibre separation. This is rather important in the production of relatively coarse yarns with a bulk of fibres passing through the spinning unit.

SUMMARY OF THE INVENTION

The drawbacks of the known fibre separating devices are removed or reduced by the fibre separating device according to this invention whose principle consists in that the slip surface of the condenser is equipped, behind the grip line area in the direction of the further motion of the fibre sliver, with means dividing the sliver into longitudinally arranged sections apart from each other at a distance different from an integer multiple of the lead width of the worm of the functional point helix of the fibre separating roller.

In principle, the measure is aimed at reducing the amplitude and increasing the frequency of the periodical deviations or irregularities. In spinning systems, this effect is useful for increasing the process stability since minor deviations in the steam of separated fibres supplied are easier to eliminate in the subsequent doubling process.

BRIEF DESCRIPTION OF THE DRAWINGS

With these and other objects in view, which will become apparent in the following detailed description, the present invention, which is shown by way of example only, will be clearly understood in connection with the accompanying drawing in which.

DESCRIPTION OF THE PREFERRED EMBODIMENTS

Figure 1:
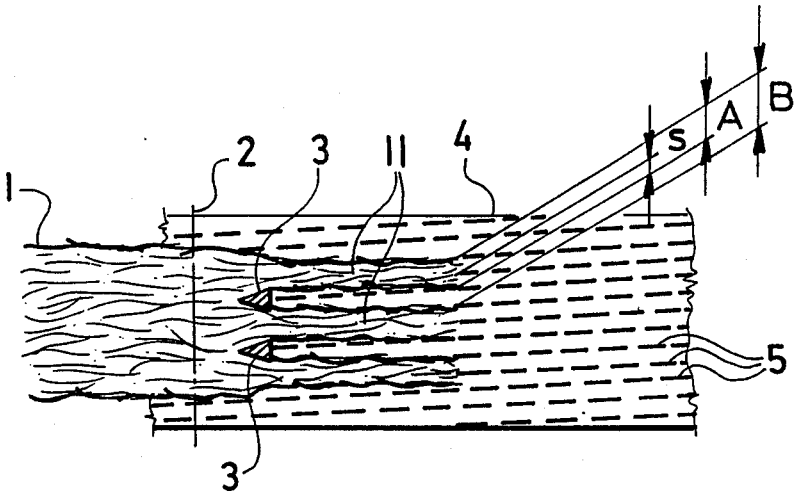
FIG. 1 shows, in plan view, schematically the supply in form of a sliver, its separation into section, and the functional points, arranged in a helix line, of a fibre separating roller.

FIG. 1 shows the sliver 1 fed in the direction of the arrow to the grip line 2 of the fibre separating roller 4. The sliver 1 is divided in the area behind the grip line into fiber sections 11 by dividing means such as dividing protrusions 3. Functional surface lines or grooves 5, arranged on the fibre separating roller 4 in the helix line with a lead width S (the roller 4 is covered by a conventional helical saw toothed wire clothing), enter the fiber sections 11 of the sliver 1 (points 5 follow a helix having the lead S; the symbol S indicates the lead of the helix).

A stands for the width of a fiber section 11, B represents the distance between fiber sections 11.

Figure 2:
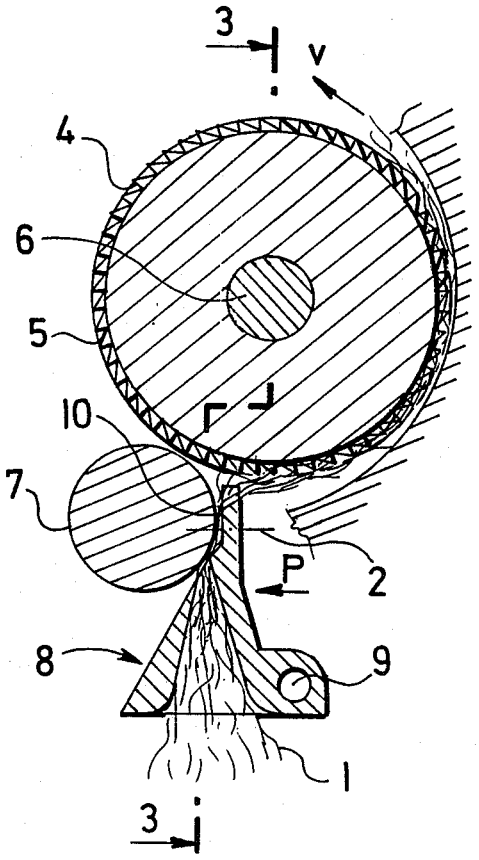
FIG. 2 shows, in one cross-sectional side view, a device for feeding and separating the fibres for a spinning unit.

FIG. 2 illustrates the condensor 8 of the sliver 1, pivotally mounted on the pin 9 and having a slip surface 10 pressed with a force P onto the feed roller 7 in the grip line 2. Behind the grip line 2, the sliver 1 is fed across the dividing means 3 into the operational reach of the functional lines or grooves 5 arranged along a helix with a lead width S on the surface of the fibre separating roller 4, mounted on the shaft 6. Through the outlet V, the separated fibres are fed into a spinning device (not illustrated) such as a spinning rotor or rotating frictional surfaces, etc.

Figure 3:
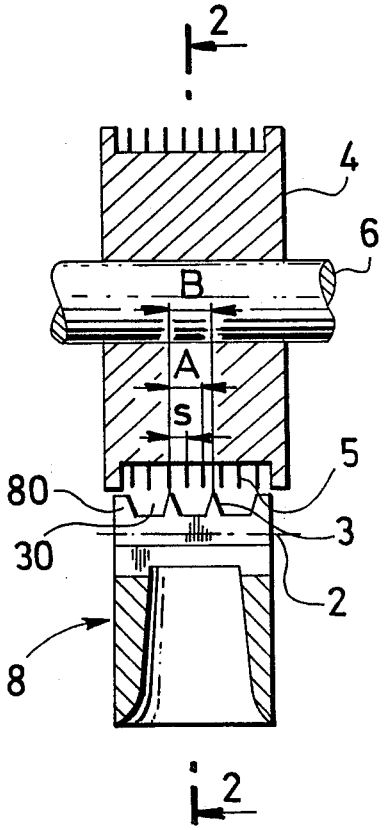
FIG. 3 shows, in cross-section A-A, the device shown in FIG. 2.

FIG. 3 illustrates, along the cross-section A—A, the device of FIG. 2. Behind the grip line 2, in the area where the sliver bends to arrive within the reach of the functional lines or grooves 5, dividing means 3 in form of protrusions 80 are provided on the condenser 8. The sliver is fed by the protrusions 80 disposed on the edges of the dividing means 3. The lead width S of the helix-like arranged functional lines or grooves 5 has a value different from the width A of the guiding semi-groove 30 between the protrusions 80 for guiding the fiber sections 11. The distance B between the dividing means 3 is correlated with the lead width S of the functional lines or grooves of the fibre separating roller 4.

MANNER OF OPERATION

The embodiments illustrated in FIGS. 1 to 3 operate as follows:

Behind the grip line 2 and while entering the separation area, the sliver is divided into a plurality of fiber sections 11, divided from each other by the dividing protrusions 3, and thus representing each an independent fibre formation processed by the functional lines or grooves 5, independently from each other in a process depending, above all, on the conditions of the fibers as they enter the functional lines or grooves 5. To a considerable extent, the irregularity of the fibre separating process is due to the helix-like arrangement of the functional lines or grooves 5, which cause the fiber sections 11 to enter the lines or grooves 5 laterally and to push them axially. Both the width A of the fibre sections 11 and the distance B between them are set so as not to be an integer multiple of the width S. Consequently, there is a phase delay in the lateral entering of the fibre sections 11 by the functional lines or grooves 5 that may be expressed in the terms of a certain angle of rotation of the fibre separting roller 4, or in the terms of a certain time interval. For instance, if the sliver 1 is divided into three fibre sections 11, as shown in the drawings, the dimensions B will be chosen so as not to be an integer multiple of the lead width S of the helix of the functional lines or grooves 5, preferably at a value $n.S+\frac{1}{3}S$, where n is an integer. With this arrangement the moment when the functional lines or grooves 5, in their helix-like configuration, enter each of the three fibre sections 11, these sections are shifted towards each other by a third of the fibre separating roller circumference, i.e., by a third of the time interval required for one complete revolution of the fibre separting roller 4.

Along with the deviations of irregular and statistical nature, regular periodical deviations occur that correspond to about 20% of the median fibre frequency and whose frequency of occurrence coincides with the speed of the fibre separating roller 4. The cause of this phenomenon, i.e., the helix-like arrangement of the functional lines or grooves 5, has been corroborated by collateral measurements on the fibre separating needle rollers that do not feature this helix-like arrangement of their needles (functional points).

The axial entering and leaving of the helix-like arranged functional lines or grooves has the most important influence in giving rise to irregularities (deviations) in the process of the sliver separation of fibres.

The separated fibres come through the outlet V and are being fed into a spinning system such as a spinning rotor where they are doubled on the collecting surface and as a yarn drawn away from it. Through the outlet V, the fibres may be fed into another system, for instance onto the surface of friction drums or other organs provided for doubling and twisting the fibres.

The periodical deviations in the number of fibres being processed are a source of irregularities in the spinning process, resulting in increased breakage rate and deteriorated properties of the yarn, especially in its increased irregularity.

While we have disclosed one embodiment of the present invention, it is to be understood that this embodiment is given by example only and not in a limiting sense.

What is claimed is:

1. An improved fibre separating device for a spinning unit of a spinning machine including a fibre separating roller having functional contact lines arranged along at least one helix on said roller, fiber sliver condensing means and feed roller means operatively mounted in said device for coaction with said fiber separating roller, said condensing means having a slip surface forming an outlet which is biased against said feed roller means, said feed roller means feeding fiber slivers jointly with said condensing means onto the surface of said fibre separating roller; the improvement comprising, said fiber separating roller having a grip line, said slip surface being operatively disposed behind the grip line in the direction of the fibre sliver motion, said condensing means being equipped with dividing means on said slip surface for dividing the sliver into discrete fibre sections having widths which are not an integer multiple of the lead width S of the helix along which the functional contact lines of the fibre separating roller are arranged.

2. The improved fibre loosening device as set forth in claim 1, wherein said dividing means on said slip surface of said condensing means are in the form of dividing protrusions.

3. The improved fibre loosening device as set forth in claim 1, wherein said dividing means on said slip surface of said condensing means are formed as dividng semi-grooves.

* * * * *